United States Patent [19]

Maleyko

[11] Patent Number: 4,915,666

[45] Date of Patent: Apr. 10, 1990

[54] LIGHTED HOOP

[76] Inventor: John R. K. Maleyko, 609 Belle River Rd., Bell River, Ontario, Canada, N0R 1A0

[21] Appl. No.: 239,776

[22] Filed: Sep. 2, 1988

Related U.S. Application Data

[63] Continuation-in-part of Ser. No. 79,478, Jul. 29, 1987, abandoned.

[51] Int. Cl.[4] ..... A63H 33/02

[52] U.S. Cl. ..... 446/242; 446/247; 446/485; 446/439; 446/490

[58] Field of Search ..... 446/242, 236, 247, 439, 446/485, 431, 450, 490; 272/1 R; 362/800, 109, 806

[56] References Cited

U.S. PATENT DOCUMENTS

| | | | |
|---|---|---|---|
| 989,944 | 4/1911 | Bramson | 446/242 X |
| 3,079,728 | 3/1963 | Melin | 446/236 |
| 3,339,939 | 9/1967 | Bowers | 272/1 R UX |
| 3,509,660 | 5/1970 | Seymour | 446/236 X |
| 3,729,860 | 5/1973 | Kargul | 446/236 |
| 3,911,264 | 10/1975 | Chao | 446/439 |
| 4,006,556 | 2/1977 | Williams | 446/242 |
| 4,100,697 | 7/1978 | Ward | 446/236 X |
| 4,380,885 | 4/1983 | Komagata | 446/236 |

*Primary Examiner*—Mickey Yu

*Attorney, Agent, or Firm*—Reising, Ethington, Barnard, Perry & Milton

[57] ABSTRACT

A lighted hoop and a kit for making a lighted hoop are disclosed for use as an amusement or exercise device. The lighted hoop having a tubular member with the ends joined to form a hoop by a coupling member having opposite ends in telescopic relation with the tube. A lighting circuit extends into the tube and includes a plurality of LEDs. The coupling member includes a battery compartment with battery contacts and a switch is mounted on the coupling member and connects the lighting circuit with the battery contacts.

10 Claims, 2 Drawing Sheets

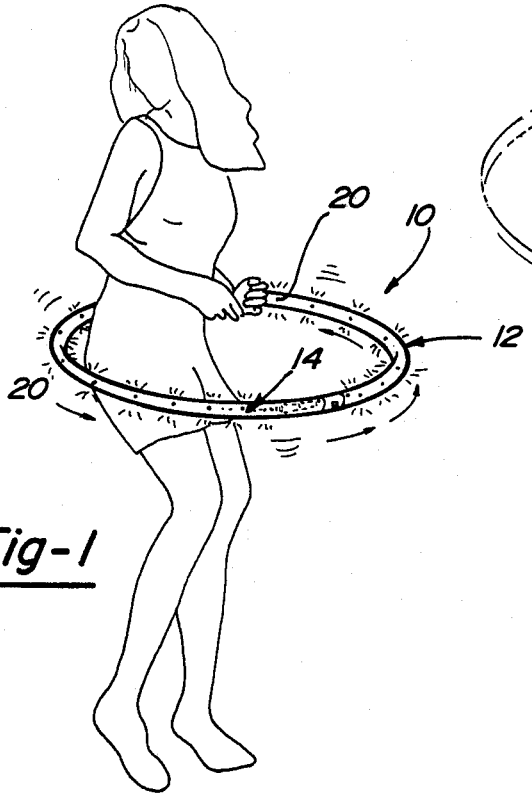
Fig-1
Fig-2
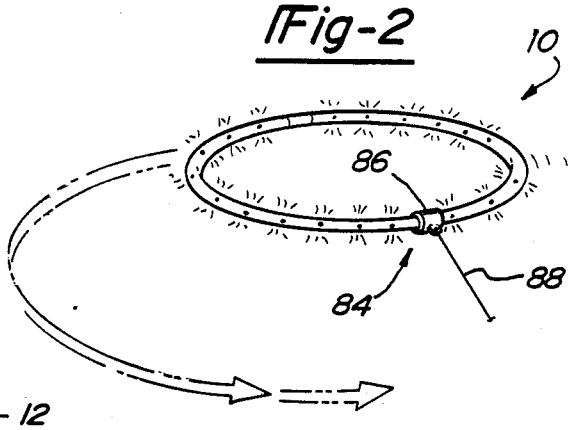
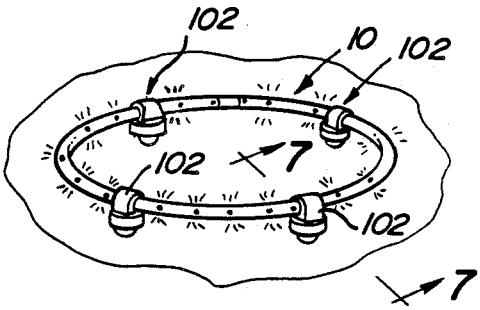
Fig-3
Fig-4
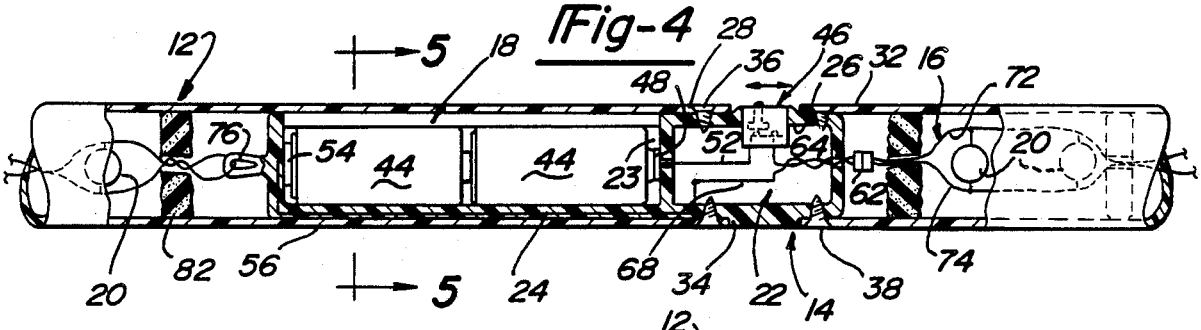
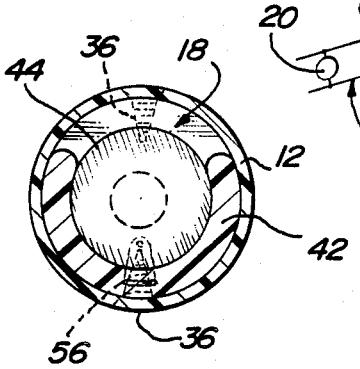
Fig-5
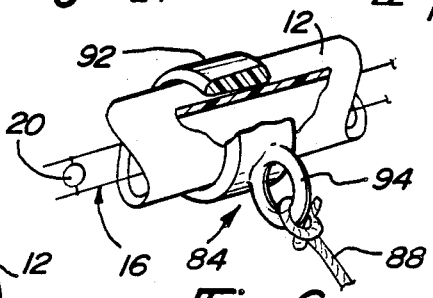
Fig-6
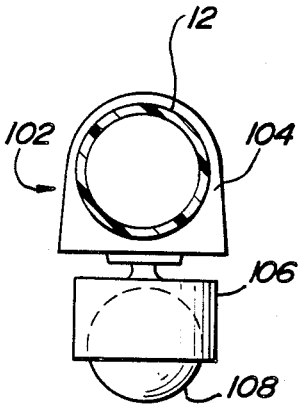
Fig-7

LIGHTED HOOP

This application is a continuation-in-part of application Ser. No. 07/079,478, filed 7/29/1987, now abandoned.

FIELD OF THE INVENTION

This invention relates to amusement and exercise devices; more particularly, it relates to a hoop device of the type that is adapted to be manually manipulated.

BACKGROUND OF THE INVENTION

Hoop devices commonly known as "hula hoops" are well known as amusement and exercise devices. Such hoop devices are typically constructed of a plastic tube formed into a circle of considerably larger diameter than a person's waist or hips. The hoop is maintained in a rotary or cycloidal motion by gyration of the hips. A hoop device of this type is disclosed in U.S. Pat. No. 3,079,728 granted Mar. 5, 1963. This patent teaches that a hula hoop, for manipulation by the hips of the user in the conventional manner must have a certain relationship of dimensions and weights. It is specified that the hoop should have an outside diameter in the range of thirty-one to thirty-seven inches with a weight of seven to ten ounces. The extruded plastic tubing has the desired weight when it has an outside diameter of about thirteen-sixteenths of an inch and a wall thickness of about one-sixteenth of an inch. A hoop device which is adjustable in size is disclosed in U.S. Pat. No. 3,729,860 granted May 1, 1973.

A lighted toy ring for being rolled on the ground or floor is described in U.S. Pat. No. 3,911,264 granted Oct. 7, 1975. The ring of this patent is transparent and includes a set of miniature lamps inside the ring. The ring is made of stiff plastic hose and the opposite ends are connected by a plug. The plug is fitted with a battery and switch for energizing in parallel circuit of the lamps. A lighted hoop for being trundled or manipulated as a theatrical contrivance is disclosed in U.S. Pat. No. 989,944 granted Apr. 18, 1911. In this hoop, a plurality of sets of lamps and batteries are disposed in a channel which opens outwardly of the hoop. Apertures in the wall of the hoop are provided for each of the lamps. A lighted hoop of the "hula hoop" type is disclosed in U.S. Pat. No. 4,006,556 granted Feb. 8, 1977. The hoop of this patent comprises an inner ring which is semi-circular in cross-section and an outer ring which is also semi-circular in cross-section, the rings being interlocked together to provide a hoop which is generally circular in cross-section. A plurality of lamps are disposed interiorly of the hoop and a battery power supply is provided for energizing the lamps.

A general object of this invention is to provide a lighted hoop which is usable as a hula hoop and which is of improved construction with enhanced amusement and exercise features.

SUMMARY OF THE INVENTION

In accordance with this invention, a lighted hoop is provided which may be used in the manner of a conventional hula hoop but with greatly enhanced amusement capability. The invention provides a hula hoop construction of small diameter, lightweight plastic tubing with a hoop diameter amply large for the hula hoop operations. Further, the lighted hoop is adapted for use in other manually manipulated operations to provide body exercise and amusement in various modes of motion. Further, the lighted hoop is of extremely rugged construction, economical to manufacture and easy to service.

Further, in accordance with this invention, a lighted hoop comprises a unitary tubular member with its ends joined by a coupling member. A lighting circuit including plural light sources is disposed in the tubular member. The coupling member includes a battery compartment and a switch is mounted on the coupling member and connected electrically with the lighting circuit and the battery contacts of the battery compartment. The coupling member is a cylindrical body and includes an annular boss intermediate the ends thereof. The ends of the coupling member extend inside the ends of the tubular member and the switch is mounted on the annular boss. Further, according to the invention, the battery compartment is a chamber in one end of the cylindrical body of the coupling member, the cylindrical body being open on one side to permit the insertion of a battery when the end of the coupling member is removed from the end of the tubular member. Preferably, each of the light sources is an LED and a retainer is disposed between adjacent LEDs for restraining motion thereof within the tubular member.

Further, in accordance with this invention, a kit for making a lighted hoop is provided so that it can be packaged in a knock-down or disassembled condition and readily assembled by the user. The kit comprises a plurality of tubular members and a coupling member, each of said members having a longitudinal axis of arcuate configuration. The coupling member includes a battery compartment and a switch with a conductor connected between one of the battery contacts and one terminal of the switch. An electrical circuit made of flexible wire and having a plurality of LEDs connected therewith extends through all of the tubular members in succession and has its opposite ends connected to the coupling member whereby the tubular members are strung on the circuit and held captive by it. The circuit wire is electrically connected with the other terminal of the switch and the other of the battery contacts and has enough slack so that members can be laid side-by-side. Each of the members is provided with ends adapted to telescopically mate with the adjacent end of the adjacent member whereby the members can be assembled to form a hoop.

Further, in accordance with the invention, the lighted hoop may be provided with a set of casters mounted in spaced relation around the circumference of the hoop to support it for translational and rotational motion.

Further, in accordance with this invention, the lighted hoop may be provided with an attachment member and a lanyard attached thereto whereby the hoop may be manipulated by the lanyard.

A more complete understanding of this invention may be obtained from the detailed description that follows taken with accompanying drawings.

DESCRIPTION OF THE DRAWINGS

FIG. 1 shows the lighted hoop of this invention being used as a hula hoop;

FIG. 2 shows the lighted hoop on a tether being used in the manner of a lariat;

FIG. 3 shows the lighted hoop on casters;

FIG. 4 is a cross-sectional view of the lighted hoop;

FIG. 5 is a view taken on line 5—5 of FIG. 4;

FIG. 6 shows a tether device for the lighted disk;

FIG. 7 shows a view taken on line 7—7 of FIG. 3;

BEST MODE FOR CARRYING OUT THE INVENTION

Figure 8:
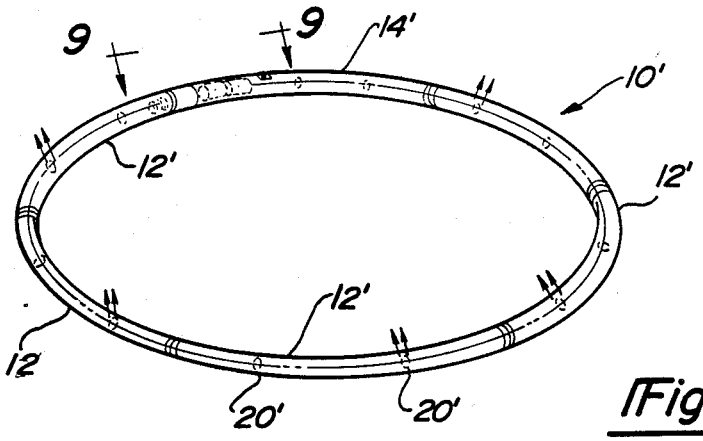
FIG. 8 shows a lighted hoop which has been assembled from a knock-down kit.

The invention is illustrated in a particular embodiment of a lighted hoop. It will be understood as the description proceeds, that the invention may be realized in different embodiments and may be used in various ways.

FIG. 1 depicts the lighted hoop 10 of this invention as it is used in the manner of a hula hoop. The hoop 10 comprises, in general, a tube 12 in the configuration of a circular hoop and having its ends joined together by a coupling member 14. The tube 12 is translucent and contains a multiplicity of light sources 20 spaced circumferentially around the tube which will cause the tube to glow with a desired degree of brightness. The term "translucent", as used herein, means that the wall of the tube transmits the light with a degree ranging from transparency to opacity. Preferably, the tube has a translucency which diffuses the light around the tube. When the lighted hoop is manipulated as depicted in FIG. 1, the brightness of the hoop and the persistence of vision give the illusion of a multiplicity of light rings emanating in orbital paths from a gyrating focal point.

The lighted hoop will now be described in greater detail with reference to FIGS. 4 and 5. As mentioned above, the tube 12 is a plastic tube; it is suitably constructed of an extruded polymeric material such as nylon and is pigmented to provide a desired color and degree of light transmissibility or translucence. The tube 12 is of thin wall construction and is extruded in such a manner as to provide a curved tube having a desired radius in an unstressed condition so that it may be formed, without collapse of the tube, into a circular hoop with the free ends disposed opposite each other in close proximity. The coupling member 14 comprises a cylindrical body suitably constructed of a polymeric material such as nylon. The coupling member 14 is of arcuate configuration having a radius of curvature the same as that of the tube 12 so that it conforms to the hoop configuration. The coupling member 14 has a battery compartment 18 and a switch compartment 22 separated by a wall 23. It has end sections 24 and 26 with an outside diameter which fits telescopically with a snug slip-fit inside the respective ends 28 and 32 of the tube 12. The coupling member 14 is provided with an enlarged diameter intermediate the end sections 24 and 26 to provide an annular boss 34. The end 28 of tube 12 is seated against the shoulder of the boss 34 and is secured to the end section 24 by a pair of screws 36, suitably of plastic material. Similarly, the end 32 of tube 12 is seated against the other shoulder of the annular boss 34 and is secured to the end section 26 by a pair of screws 38.

The battery compartment 18 comprises a cylindrical chamber defined by a cylindrical wall 42 which is open on one side to permit insertion of a pair of batteries 44. The switch compartment 22 houses a switch 46 which is mounted in the annular boss 34. The switch 46 is a conventional slide switch having the actuator button located on the exterior or outer periphery of the hoop. The battery compartment 18 is provided at one end with a positive battery terminal 48 which is connected by a conductor 52 with one terminal of the switch 46. The battery compartment 18 is provided at the other end with a negative terminal 54 which is a resilient bent end of a spring metal strip 56. The strip 56 is embedded in the wall of the battery compartment and extends into the switch component. The other end of the strip 56 is connected by a conductor 58 to one terminal of an electrical connector 62. The other terminal of the switch 46 is connected through a conductor 64 to the other terminal of the electrical connector 62. The lighting circuit 16 is connected with the electrical connector 62.

The light circuit 16 comprises a pair of conductors 72 and 74 connected respectively through connector 62 with conductors 64 and 58. The conductors 72 and 74 extend into the tube 12 and terminate in a mechanical connection with an eyelet 76 on the end of the battery compartment 18. The lighting circuit also comprises the plurality of light sources 20 each of which is a light emitting diode (LED). The sources or LEDs 20 are connected in parallel with each other across the conductors 72 and 74. The LEDs are adapted, when energized by the batteries 44, to emit light of substantial intensity in the visible portion of the spectrum. Each LED is connected by its respective terminals to the conductors 72 and 74, suitably by a soldered connection, without need for any special housing or mounting. The LEDs are spaced along the length of the tube 12 by intervals which may range from four to fifteen inches depending upon the desired number of LEDs and the desired pattern and intensity in the resultant lighting effect. The LEDs may be of the same color or different colors, as desired. In order to retain the LEDs against undesired movement within the tube 12, a retainer 82 is disposed adjacent each of the LEDs. The retainers 82 take the form of foamed plastic plugs, suitably foamed polyurethane, which have a radial slot for accommodating the conductors 72 and 74. The retainers 82 are suitably of larger diameter than the inside diameter of the tube 12 in their free or unstressed condition and thus are held in place by friction with the tube.

The lighting circuit 16 is connected electrically in series with the switch 46 and the terminals 48 and 54 of the battery compartment. Thus, when the switch 46 is closed, the batteries 44, in series with each other, are connected across the LEDs 78 which are in parallel with each other and hence they are illuminated simultaneously. When the switch 46 is open, the LEDs are turned off.

Figure 9:
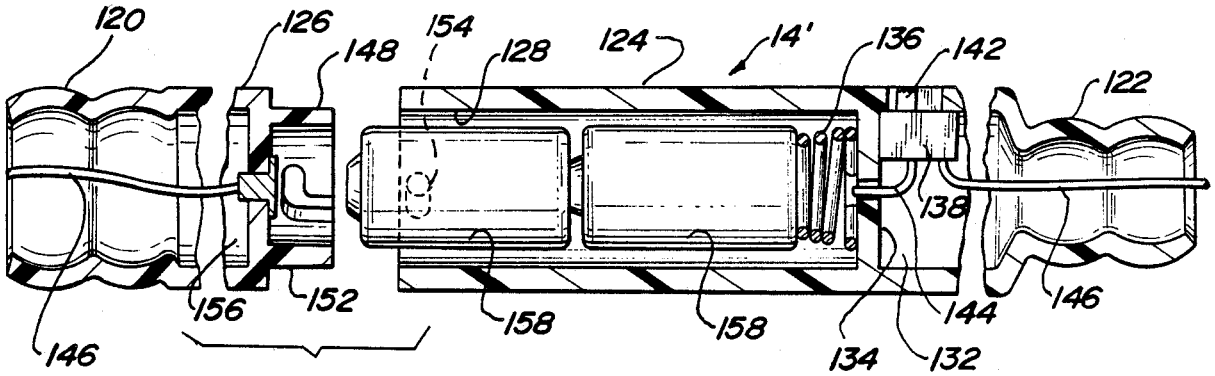
FIG. 9 is a sectional view taken on lines 9—9 of FIG. 8.
Figure 10:
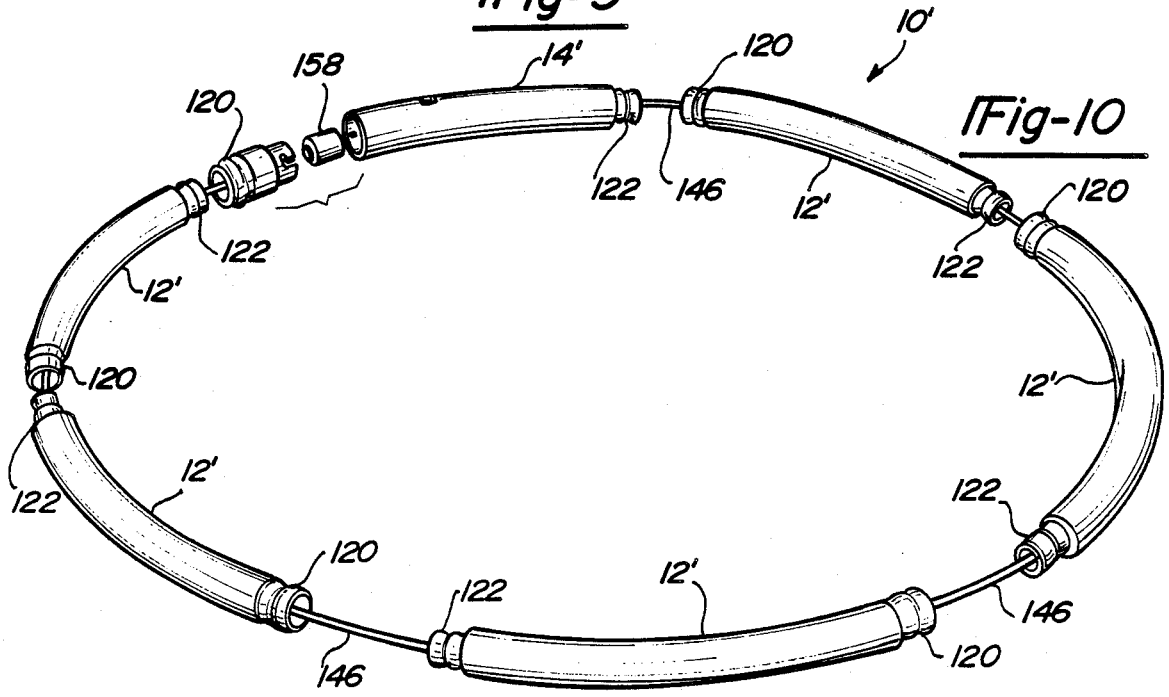
FIG. 10 shows the parts of the hoop kit laid out ready for assembly.

Another embodiment of the invention is shown in FIGS. 8, 9 and 10. In this embodiment, the lighted hoop 10', as illustrated in FIGS. 8 and 10, comprises a plurality of tubular sections or members 12' and a coupling member 14' which are joined together to form the hoop. In its unassembled or "knock-down" form, as shown in FIG. 10, the parts constitute a kit which can be assembled to form the hoop as shown in FIG. 8. As will be described below, the kit comprising the unassembled members in knock-down form may be laid side-by-side in compact form for packaging or storage.

As shown in FIG. 10, each tubular member 12' is a thin walled hollow platic tube and has a longitudinal axis of arcuate configuration. One end of each tubular member 12' is provided with an end fitting 120 which constitutes a female member of a telescopic joint to be formed with the adjacent tubular member. The other end of each tubular member is fitted with the male member 122 of a tubular joint to be formed with the adjacent tubular member. Similarly, one end of the coupling member 14' is provided with a male member 122 of a telescopic joint to be formed with the adjoining tubular member. The other end of the coupling member 14' is provided with a female member 120 of a telescopic joint to be formed with the adjacent tubular member 12'.

The coupling member 14' comprises an elongate body of circular cross-section and preferably constructed of molded plastic and having wall sections of thickness about the same as that of the tubular members 12. The coupling member 14' has a longitudinal axis of arcuate configuration. The tubular members and the coupling member all have an arcuate configuration of the same radius and have an arcuate length such that the fitting together of the telescopic joints therebetween forms a complete circle without any requirement for substantial bending of the members. As shown in FIG. 9, the coupling member 14' comprises a body portion 124 and a cap portion 126. The body portion 124 is provided with a cylindrical cavity which forms a battery compartment 128. It also includes a switch compartment 132 at the end adjacent the male member 122. The switch compartment 132 is separated from the battery compartment 128 by a wall 134. The battery compartment is provided with a battery contact in the form of a coil spring 136. A switch 138 is mounted in the switch compartment 132 and is provided with a switch actuator in the form of a slide button 142 which is accessible for manual operation at the exterior of the coupling member 14'. One terminal of the switch 138 is connected by a conductor 144 with the battery contact 136. A flexible wire 146 is connected with the other terminal of the switch 138 and constitutes an electrical circuit which will be described below. The cap 126 and the body 124 are provided with a quick detachable connection in the form of a bayonet connector 148. This connector comprises the bayonet slot sleeve 152 unitary with the cap 126 and the bayonet pin 154 is mounted interiorly of the battery compartment. A battery contact 156 is provided centrally in the end wall of the cap 126. The flexible wire 146 has its other end connected with the contact 156. The battery compartment 128 is adapted to receive a pair of batteries 158 between the battery contacts 136 and 156 as indicated. The batteries may be changed by opening and closing of the battery compartment by the bayonet connector 148 on the cap 126 and body 124.

The electrical circuit comprising the flexible wire 146 includes a plurality of LEDs 20' in series connection. At leat one LED is disposed within each of the tubular members 12'. As shown in FIGS. 8, 9 and 10, the electrical circuit is a series circuit in which the LEDs 20' are in series with each other and the opposite ends of the wire 146 are connected, respectively, to one terminal of the switch 138 and to the battery contact 156, i.e. across the batteries and switch. Alternatively, the parallel circuit shown in the embodiment of FIG. 4 may be used.

The length of the flexible wire 146, which has its ends connected with the coupling member 14' and which is threaded through all of the tubular members 12' in succession, is provided with enough slack so that the members 12' and 14' may be laid side-by-side for packaging or storing before the hoop is assembled. In this condition, the spacing of the LEDs 20' and the placement thereof along the flexible wire 146 is preferably such that all of the LEDs are disposed within one or the other of the tubular members 12', i.e. they are not exposed between the disasembled sections. When the telescopic joints between the tubular members 12' and coupling member 14' are put together, the closed hoop 10' of FIG. 8 is formed.

The lighted hoops 10 and 10' may be used as a hula hoop as shown in FIG. 1 or in different modes, as shown in FIGS. 2 and 6, to provide variation in a form of entertainment or exercise afforded by the hoop. In this embodiment, the lighted hoop is adapted to be used in the manner of a lariat and is swung in controlled circles about the user's body or overhead. It is adapted, for example, for use as an element in the routine of a baton twirler for entertainment purposes. For this purpose, the lighted hoop 10 is provided with a tether 84 which comprises an attachment member 85 and a lanyard 88. The attachment member 86 comprises a circular ring 92 having an inside diameter which has a snug fit with the outside diameter of the tube 12. Preferably, the ring 92 has a tapered inside diameter so that a firm friction grip may be provided with the tube. The ring 92 is provided with an eyelet 94 which may be positioned on the outer periphery of the tube 12. The lanyard 88 is tied to the eyelet. When it is desired to use the lighted hoop 10 as a lariat, the attachment member 86 may be added to the hoop by opening the hoop at the end 32 of the tube 12 and inserting it through the ring 92 and then reconnecting the end 32.

The lighted hoops 10 and 10' may also be used in the manner of a spinning toy or throw toy as illustrated in FIGS. 3 and 7. For this purpose, the lighted hoop 10 is adapted to be supported on a floor, driveway or other such surface for rotational and translational motion. To this end, a set of four casters 102 are provided on the lighted hoop. Each caster comprises a support ring 104 which is adapted to fit over the tube 12 in a tight slip-fit relationship. The caster further comprises a socket 106 which depends from the support ring 104 and retains a spherical roller 108. The roller 108 is rotatably held in the socket 106 and serves as a multi-directionally rotatable wheel. The casters 102 are mounted in spaced relation around the hoop 10 and may be installed by disconnecting the end 32 of the tube 12 and sliding the casters into place. Preferably the lighted hoop is provided with three or more casters so that the hoop is held out of contact with the supporting surface.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A kit for making an entertainment device comprising:

a plurality of tubular members each having a longitudinal axis of arcuate configuration and constructed of translucent plastic material, a coupling member having a longitudinal axis of arcuate configuration and including a battery compartment with battery contacts at each end thereof, a switch mounted on said coupling member and being accessible for manual operation externally of said coupling member, a conductor connected between one of said battery contacts and one terminal of said switch, an electrical circuit made of flexible wire and having a plurality of LEDs connected therewith and extending through all of said tubular members in succession and having its opposite ends connected to said coupling member whereby the tubular members are strung on said circuit and held captive thereby, said circuit wire being electrically connected with the other terminal of said switch and the other of said battery contacts and having enough slack so that said members can be laid side-by-side, and each of said members being provided with ends adapted to telescopically mate with the adjacent end of the adjacent member, whereby the members can be assembled to form a hoop.

2. The invention as defined in claim 1 wherein said circuit is a series circuit connection of said LEDs by said wire and said wire is electrically connected between said other battery contact and the other terminal of said switch.

3. The invention as defined in claim 1 wherein said circuit is a parallel circuit connection of said LEDs by said wire and said wire is electrically connected between said other battery contact and the other terminal of said switch.

4. The invention as defined in claim 1 wherein said LEDs are spaced along said circuit so that there is at least one LED in each of said tubular members, said LEDs being spaced apart far enough and located along said circuit so that each LED will be disposed inside one of said tubular members when the tubular members are laid side-by-side.

5. The invention as defined in claim 1 including a set of at least three casters mounted in spaced relation around the circumference of said hoop to support said hoop for translational and rotating motion.

6. The invention as defined in claim 1 including an attachment member on said hoop and a lanyard attached to said attachment member whereby the hoop may be manipulated by manual control of said lanyard.

7. An amusement device comprising:

a unitary tubular member in a hoop configuration with the ends of the tubular member disposed opposite each other, the tubular member being constructed of translucent plastic material, a lighting circuit including a plurality of light sources disposed inside the tubular member, a coupling member having opposite ends in telescopic relation, respectively, with the ends of said tubular member for joining said tubular member in said hoop configuration, said coupling member comprising a cylindrical body with an external annular boss intermediate the ends thereof, the ends of said body extending, respectively, inside the ends of said tubular member, said coupling member including a battery compartment with battery contacts, said battery compartment comprising a chamber adjacent one end of said cylindrical body, said cylindrical body being open on one side to permit the insertion of a battery when said one end is removed from said tubular member, and a switch mounted on said annular boss and connected electrically in series with said lighting circuit and said battery contacts, said switching being accessible for manual operation externally of said coupling member.

8. The invention as defined in claim 7 wherein each of said light sources is an LED, all of said LEDs being connected in parallel with each other in said lighting circuit, and including a retainer between adjacent LEDs for restraining motion of the LEDs within the tubular member.

9. The invention as defined in claim 7 including a set of at least three casters mounted in spaced relation around the circumference of said hoop to support said hoop for translational and rotating motion.

10. The invention as defined in claim 7 including an attachment member on said hoop and a lanyard attached to said attachment member whereby the hoop may be manipulated by manual control of said lanyard.

* * * * *